United States Patent [19]

Gallone et al.

[11] 3,933,965

[45] Jan. 20, 1976

[54] PROCESS FOR THE MANUFACTURE OF RODS OF THERMOPLASTIC MATERIAL, HAVING INTERNAL CAPILLARY DUCTS, FOR THE PREPARATION OF PEN NIBS INCORPORATING CAPILLARY INK DUCTS

[75] Inventors: Ermenegildo Gallone; Francesco Mazzier, Settimo Torinese, both of Italy

[73] Assignee: Global Control Corporation, Luxemburg

[22] Filed: May 13, 1974

[21] Appl. No.: 469,682

[30] Foreign Application Priority Data

May 11, 1973 Italy ..... 68354/73
Oct. 30, 1973 Italy ..... 70200/73

[52] U.S. Cl. ..... 264/177 F; 15/445; 264/150; 264/151; 264/209; 264/210 F; 401/198; 401/199; 401/265; 401/284; 401/292; 428/36; 428/376; 428/397; 428/398

[51] Int. Cl.[2] .. B28B 21/52; B43K 8/02; D01D 5/12

[58] Field of Search ..... 401/198, 199, 265, 284, 401/292; 264/150, 151, 177 F, 209, 210 F; 15/445; 166/175; 428/36, 37 C, 397, 398, 178

[56] References Cited

UNITED STATES PATENTS

| | | | |
|---|---|---|---|
| 3,113,336 | 12/1963 | Langnickel | 401/199 |
| 3,338,216 | 8/1967 | Roller | 401/265 |
| 3,518,019 | 6/1970 | Kakamura | 401/265 |
| 3,520,629 | 7/1970 | Otsuka | 401/265 |
| 3,538,208 | 11/1970 | Otsuka | 264/151 |
| 3,586,454 | 6/1971 | Funakashi | 401/292 |
| 3,604,817 | 9/1971 | Funakashi | 401/284 |
| 3,614,247 | 10/1971 | Otsuka | 401/199 |
| 3,614,248 | 10/1971 | Otsuka | 401/292 |
| 3,687,561 | 8/1972 | Phillips | 401/265 |
| 3,718,401 | 2/1973 | Kiriu | 401/265 |
| 3,729,270 | 4/1973 | Nakano | 401/292 |
| 3,744,923 | 7/1973 | Bok | 401/265 |
| 3,778,495 | 12/1973 | Woolley | 401/265 |
| 3,830,576 | 8/1974 | Kohno et al. | 401/265 |

*Primary Examiner*—J. C. Cannon
*Attorney, Agent, or Firm*—Young & Thompson

[57] ABSTRACT

Pen nibs are made by extruding rods from fused thermoplastic material, with a cavity in the rod of star-shaped cross-sectional configuration. The extruded rod is then cooled and mechanically drawn to reduce its diameter about 50%, which closes the inner ends of the arms of the star and brings them together at the center of the rod, while leaving the outer ends of the arms relatively large. The resulting product is then sharpened at both ends for use as a pen nib.

7 Claims, 7 Drawing Figures

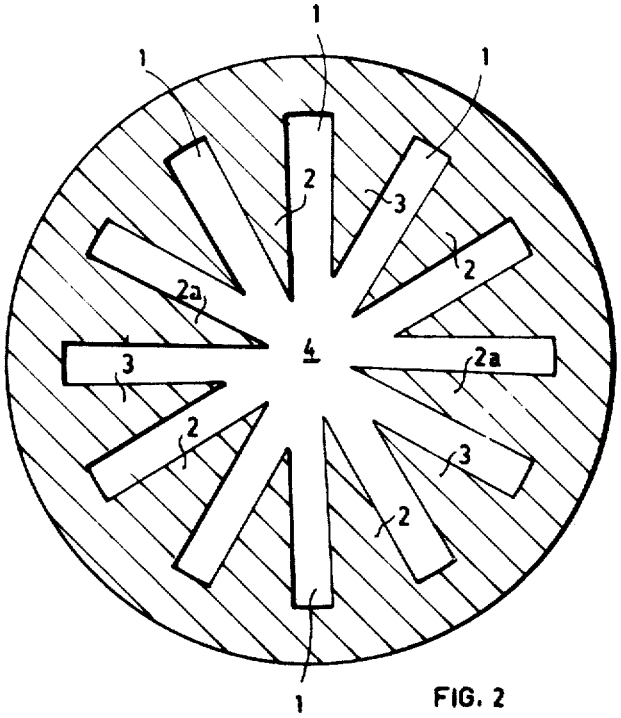
FIG. 2
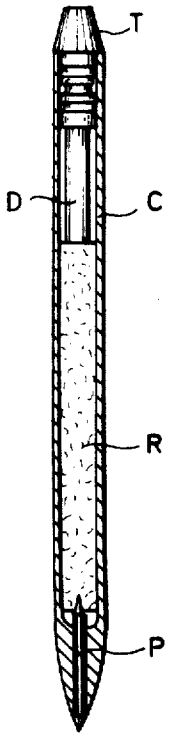
FIG. 1
FIG. 5
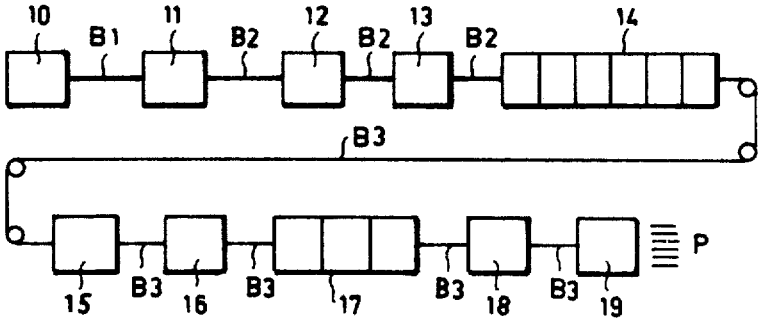

PROCESS FOR THE MANUFACTURE OF RODS OF THERMOPLASTIC MATERIAL, HAVING INTERNAL CAPILLARY DUCTS, FOR THE PREPARATION OF PEN NIBS INCORPORATING CAPILLARY INK DUCTS

The present invention relates to a process for the manufacture of rods of thermoplastic material having internal capillary ducts, for the preparation of pen nibs, e.g. styli having, capillary ink ducts.

Pen nibs are known consisting of a small rod of thermoplastic material of circular outer profile, having internally a longitudinal capillary duct of star-shaped cross-section; the two ends of the rod are tapered to serve one for normal writing purposes and the other to allow the rod to penetrate into an ink-impregnated pad or similar reservoir.

Pen nibs of this type are made from an extruded rod, preferably of circular outer profile, having inside a longitudinal duct of star-shaped cross-section.

Various pen nibs of the type in question are already known from the earlier state of the art but, as will subsequently be explained, they all have a certain number of disadvantages.

In order that a pen nib of the type in question can perform its function, which is that of obtaining ink flow from the pad or other reservoir in which one of the tips of the pen nib shank is inserted, to the other tip for writing purposes, the internal duct must have a good capillary attraction.

As is known, a duct has a higher capillary force, i.e. it exerts much stronger "suction" power on a liquid, the smaller its bore. In particular, in the case of a duct of star-shaped cross-section, to ensure a strong capillary force, it is necessary that the radially arranged ducts bounded by the "arms" of the cross-section be as narrow as possible.

A pen nib having a capillary duct of (star-shaped) cross-section is described in U.S. Pat. No. 3,338,216 of Frank W. Roller Sr. on Aug. 29, 1967. The ducts, arranged radially in this pen nib, are all equal in size, distributed symmetrically around the axis and have substantially parallel sides. The cross-section of the completed star-shaped duct of the required dimensions, is finally shaped directly at the outlet of an extrusion die having a corresponding star-shaped configuration.

In the Roller patent, it is stated that the width of the capillary ducts may be of the order of 0.005 to 0.0025 inches, i.e. 0.127 to 0.0635 mm. It is probable that these dimensions can be obtained directly by extrusion, but the resulting capillary force is comparatively poor. Furthermore, with the star-shaped configuration of the duct according to the Roller patent, there is a longitudinal bore in the centre of the pen nib, into which all the radially-arranged longitudinal ducts discharge. For geometrical reasons, this cavity has of necessity a cross-section of a higher order of magnitude than that of the individual ducts, which means that its capillary force is less than that of the ducts. The reduced capillary force of the central cavity entirely or partially reduces the benefit of the capillary force of the ducts and, furthermore, the presence of this cavity is a real and actual barrier, in practice separating the radially arranged ducts from each other, for which reason, if one of these is blocked at the end, due, for instance, to defective manufacture or to a foreign body or a clot in the ink, ink is no longer supplied to this duct by the other ducts downstream of the obstruction. The blocked duct, which could still function if it could receive ink downstream of the obstruction, therefore remains inoperative and this makes the pen nib "asymmetrical" in the sense that it fails to operate when the pen nib is angularly rotated about its longitudinal axis in the direction of the blocked duct. Obviously, the greater the number of blocked ducts, the more serious is the degree of asymmetry.

The fact that the capillary force of the star-shaped duct is of modest proportion does not constitute a serious drawback if the pen nib is to be coupled with a normal cartridge of very fluent ink, such as is used in fountain pens. In fact, since a cartridge of this type has no inherent capillary effect, the pen nib duct only requires to have a modest capillary force to ensure smooth transfer of the ink to the paper. This solution is only permissible, however, in the case of comparatively expensive rechargeable pens, when the ink consumption is a relatively unimportant factor.

The pen nibs here in question are, however, intended especially for cheap, widely-used pens of the throw-away type, in which the filler ink is contained in a very cheap long pad of porous material (e.g. polyester chips or threads) enclosed in an impermeable sheath.

If a pen nib having a modest capillary force is coupled with an ink-impregnated pad, drawbacks arise inasmuch as the pad itself has an inherent capillary force which is frequently of the same or even a higher order of magnitude than that of the pen-nib duct. The capillary force of the pad acts counter to that of the pen nib, due to which the pad tends to hold back the ink. Accordingly, it sometimes happens that the counter force of the pad interrupts the flow of ink in the pen nib duct while it is being used for writing, so that writing with it is no longer possible, or that a pen which has remained unused for some time is no longer ready for use, inasmuch as the pad has reabsorbed the ink or has drawn it too far back from the tip of the pen nib.

Another drawback with pen nibs having a capillary duct with a star-shaped cross-section in accordance with the Roller patent lies in the fact that at the point where the central cavity opens into the tapered tip intended for writing on paper, this tip, instead of being as sharp as possible, as would be desirable to ensure a very fine script, is blunted, i.e. the tapered end point is really a truncated cone and the diameter of its minor base determines the width of the script.

It is therefore impossible, with pen nibs having a duct of star-shaped cross-section, in accordance with the existing state of the art, such as the pen nib according to the Roller patent, to obtain a very fine script, even when the pen nib is new, and this drawback increases with use, insofar as the "segments" of material forming the boundaries between the radially arranged channels do not support one another and, apart from becoming worn, they yield appreciably.

Yet another drawbacks lies in the fact that the said "segments", projecting beyond the inner rim of the pen nib contour, and being elastic, vibrate during the writing process and often cause the ink to splutter on the paper, still further impairing the appearance of the script.

In the prior state of the art, to eliminate these drawbacks, a pen nib having a "filled" tip has been designed, i.e., having, instead of a single duct of star-shaped cross-section, a crown of longitudinal ducts arranged symmetrically around the longitudinal axis of the pen nib. With this solution, although it is possible to obtain a very fine tip and therefore a very fine script, because the ducts do not intercommunicate, nevertheless, blocking of one or more of the ducts inevitably makes the pen nib asymmetrical.

In the prior state of the art, in order to obtain star-shaped ducts of smaller cross-section and therefore having a capillary force greater than could be obtained by direct extrusion, it was sought to subject the rod of thermoplastic material to stretching immediately after extrusion. Solutions of this kind are disclosed, e.g. in U.S. Pat. Nos. 3,518,019 granted on June 30, 1970 to Kinichi Nakamura and No. 3,538,208 granted on Nov. 3, 1970 to Katsumi Ohtsuka.

The stretching of the thermoplastic material must necessarily take place while it is still at a high temperature and plastically deformable and therefore will be denoted as the "sealing or fusing temperature". As will be realised, if, under these conditions, the rod is stretched until it is reduced to a diameter such that the tips of the material segments bounding the radially arranged ducts make mutual contact, which would be desirable in order to eliminate the central cavity, this would cause them to fuse together and would eliminate the advantage of inter-channel communication which, as already stated, is essential, to ensure that the pen nib functions reliably and symmetrically.

According to the Nakamura patent, stretching is effected between an extrusion die and a drawplate gauging the outer diameter and it can be assumed that this stretching process terminates in accordance with the drawplate. Therefore, the final spacing between the internal segments is that arrived at when the drawplate is reached. Should this spacing gap be zero, i.e. if the tips of the segments have already made mutual contact, they will become welded together, unless they have reached a temperature sufficiently low to prevent mutual fusion or welding precisely at the instant when they make mutual contact.

It is hardly imaginable that in a continuous industrial process it is possible reliably to find a controllably variable point between the extrusion die and the gauging drawplate at which the segments make mutual contact precisely at the instant when their temperature has fallen below the sealing temperature. If the temperature has already fallen below this value, this implies that the entire rod is already cooled to such an extent as to be no longer stretchable and therefore it is no longer possible for the tips of the segments subsequently to make close mutual contact. If, on the other hand, the tips of the segments make mutual contact before the temperature has dropped to the said value, as already stated, they fuse together.

External cooling of the rod, as effected in accordance with U.S. Pat. No. 3,518,019, Nakamura, is ineffective for cooling the segments since the core of the rod inevitably remains hotter than the outside, and therefore the latter reaches the state in which it can no longer be stretched before the segments have cooled sufficiently to prevent mutual fusion.

The ideal solution would be to cool the bar from the inside, so as to cool the segments before the outside, but this is not a practicable proposition. In U.S. Pat. Nos. 3,518,019, Nakamura and 3,538,208, Ohtsuka, it is stated that the extrusion process is effected by passing a fluid (air according to the Nakamura patent, a liquid or gas according to the Ohtsuka patent) into the rod from the upstream side of the extruding die. This should serve to preserve the original configuration of the ducts and prevent their walls fusing together after extrusion and during the stretching process, but it does not cool the inside parts of the rod. In point of fact, the thermoplastic material in the die is at a high temperature (with an acetal resin, this is of the order of 170°C) and if a liquid is introduced inside, the liquid is liable to boil and the resulting steam inhibits the extrusion process, which is extremely sensitive at the die outlet and can even be adversely effected by the draught caused by a hand waved near it.

It is not possible to obtain a better result by admitting air since the latter could not be appreciably above atmospheric pressure and the extruded product at the die outlet is very hot and liable to burst if subjected to even the least internal overpressure.

Apart from this, any fluid introduced into the extruded plastic material from the upstream side of the die, which is the only possible point at which it could be introduced, could never be fed in at a sufficient rate to effect cooling and would, on the contrary, be heated to a temperature almost as high as that of the molten material.

From the abovesaid, it will be understood, in particular in accordance with the Nakamura patent, that it is quite essential to stop the process of drawing the thermoplastic material before the segment tips make contact, i.e., a central bore, however small, must be left, in spite of all the resulting drawbacks.

Irrespective of the drawbacks involved in the stretching of the plastic rod, the Nakumura patent seeks to solve the problem of obtaining a greater capillary force in the radially arranged ducts by proposing that the ducts shall have a width gradually reducing towards the centre of the radial arrangement, i.e. having a capillary force which increases towards the centre. For this purpose, the thermoplastic rod is extruded through a die, the star-shaped cross-section of which has partitions tapered according to a configuration similar to that desired for the ducts. Thus, as directly provided at the die outlet, the star-shaped duct still has a central bore, in accordance with the Roller patent. This cavity is reduced to a theoretical minimum during the drawing process which, as seen above, cannot be continued to the point when the tips of the segments make contact.

The solution according to the Nakamura patent would be acceptable, but for the difficulty, if not the impossibility of applying it practically and safely by means of the drawing process and would make it possible to obtain a strong capillary force in the star-shaped duct, particularly in the centre of its full cross-section, both as a result of the converging cross-section of the ducts and as a result of the almost total elimination of the central cavity. Moreover, the great reduction in the size of the central cavity permits a very fine script.

However, the thermoplastic segments, all of the same radial length, in consequence of the reduced cross-sectional area, approach each other at their tips substantially at the centre, without making contact and thus, while not abutting, still overlap the rim of the pen nib cross-section and can thus vibrate during the waiting process, so that there is still the drawback of spluttering of the ink.

In view of the above-indicated disadvantages, as far as is known the solutions proposed in the Nakamura patent, in spite of their advantages, do not appear to have found any practical application.

The only pen nibs with a capillary feed duct of star-shaped cross-section at present available on the market, although not very popular, are still those of the type according to U.S. Pat. No. 3,338,216, granted to Roller, the capillary force of which has been somewhat improved probably by means of a fairly moderate stretching process to avoid in great measure the risk of fusion of the duct walls. In these commercially available pen nibs, the width of the ducts is of the order of 0.020 to 0.010 mm, but there is still a central bore, the diameter of which is of the order of 0.05 mm, for which reason the comparatively high advantages of the capillary force of the ducts are lost.

The objects of the present invention are, therefore, to eliminate the drawbacks described above, i.e. to provide a pen-nib of the type considered which:

- has a far stronger capillary force than that of pen nibs in accordance with the prior state of the art, due to the reduced cross-section of the various parts of its internal duct;
- does not have a central cavity but nevertheless has inter-communicating radially arranged cavities.

In accordance with the invention, these purposes are attained by means of a process for manufacturing a thermoplastic rod having internal capillary ducts, for making pen nibs with capillary ink passages. The process is characterised in that it essentially comprises stages consisting of extruding the rod from a molten mass of the thermoplastic material through a die so shaped as to form inside the extruded rod longitudinal ducts, in drawing the rod, if necessary, to reduce the width of the ducts, and then cooling the extruded rod to a temperature lower than that at which the thermoplastic material fuses, further subjecting the cooled rod to a mechanical drawing process reducing its outside diameter and, simultaneously, the width of the internal ducts, to increase the capillary force.

In accordance with a preferred form of embodiment, the process in question essentially comprises the stages of extruding the rod from a molten mass of thermoplastic material through a die so shaped as to form inside the extruded rod, a longitudinal duct of star-shaped cross-section such that neither the tips of the segments delimiting the radially arranged ducts, bounded by the "arms" of the star-shaped cross-section, nor the sides of these segments come into contact in any drawing process necessary to reduce the width of the ducts, thereafter cooling the extruded rod to a temperature below that which the thermoplastic material fuses, and then subjecting the cooled rod to a mechanical drawing process which reduces the outside diameter at least by an amount such that, if the said reduction were obtained by stretching whilst hot, the tips and/or the sides of the segments would fuse together.

By means of the mechanical drawing process, the outside diameter of the cooled rod is advantageously reduced to such an extent as to cause at least some of the tips of the segments to come together substantially at the centre of the cross-section and/or to overlap this centre, in such a way that the tips and/or the sides of the segments thus brought into mutual contact without fusing, delimit capillary intercommunication between all the radially arranged ducts.

These final results could clearly not have been obtained by means of a stretching process which, as has been seen above, since it has to be carried out at a high temperature, at which the thermoplastic material fuses, would not make it possible to obtain a "solid" centre but having intercommunicating ducts between the channel ducts.

However, one form of application of the process adopted in practice makes it possible to start with an extruded rod of large cross-section, which is advantageous inasmuch as it facilitates the manufacture of the extrusion die; after extrusion and prior to cooling, the rod is subjected to a preliminary stretching operation which reduces the outside diameter to such an extent that neither the tips nor the sides of the segments make mutual contact.

In this way, with a suitable configuration of the star-shaped crosssection, it is possible, as will subsequently become more apparent, to effect a preliminary reduction of the outside diameter of the rod down to 60% and then draw the stretched and cooled rod mechanically, reducing its diameter by a further 50%, i.e. attaining an overall reduction in the diameter of 80%, compared with the original value.

The invention further relates to a pen nib made from a rod subjected to the above-described process and with a highly advantageous internal configuration. This pen nib is characterised in that the radially arranged capillary channels, bounded by the "arms" of the star-shaped cross-section are separated from each other by segments of thermoplastic material, the tips of at least some of which, as a result of reduction of the external diameter of the extruded rod, effected by means of a mechanical drawing process at a temperature lower than the fusion temperature of the thermoplastic material, have been crowded substantially into the centre of the cross-section and/or overlap this centre, whereas at the same time, between the tips and/or the sides of the segments which in this way are brought into mutual contact without fusing, capillary ducts are formed between all the radially arranged channels.

In accordance with a preferred form of embodiment of the invention, the pen nib is made from an extruded rod, the radially arranged channels in the star-shaped cross-section whereof have a substantially constant width radially and are separated from each other by thermoplastic segments, the tips of some of which, designated "long segments" are nearer the centre of the cross-section than the remaining segments, designated "short segments" the outside diameter of the said extruded rod having been reduced by the said mechanical drawing process by an amount such as to crowd the tips of the long segments and the parts adjacent to the tips of these segments substantially into the centre of the cross-section in a deformed condition, delimiting between them intercommunicating capillary ducts between the aforesaid channels, while other capillary ducts are formed between the sides of each adjacent pair of segments and, simultaneously, the said channels are decreased in width, tapering down to virtually zero width of the ducts in the central part of the overall cross-section.

As will be seen, to obtain the advantageous tapering cross-section with a greatly increased strength of the capillary force in the central region of the pen nib, by means of a mechanical drawing process, it is not necessary to use an extrusion die having a geometrical configuration similar to that of the desired overall cross-section, as is the case, however, with the stretching process.

The process now described makes it possible to obtain good results but still has certain disadvantages in the case of large-scale, continuous industrial production.

As the extrusion process is carried out with the customary blast of air or another gas inside the rod, it may happen that small uncontrolled variations in the blast temperature or in the temperature of the thermoplastic material give rise to local thickening of the outside cross-section of the extruded rod.

When a thickened portion of the continuous rod reaches the first mechanical drawing stage, the part of the rod located downstream is subjected to a stretch which frequently results in rupture and interrupts production which is not permissible in a continuous industrial process.

One of the primary aims of a later improvement in accordance with the present invention is precisely to prevent tearing of the rod by thickening of its cross-section which, in practice, is inevitable.

Another drawback is due to the fact that, with a thermoplastic rod having an external cross-section which is cylindrical or other than concave, the internal segments, when cooling from the extrusion temperature, are subjected to a shrinkage process which tends to shorten the radial dimensions in a manner not easily controlled. As is known, the overall shrinkage to which a material, in process of cooling, is subject in a particular direction depends above all, if there is a direct proportional relationship, on the thickness of the material in this particular direction. In the case of the said thermoplastic segments, the contraction experienced by these segments in the radial direction is therefore substantially proportional to the radial distance from the tip of the segment to the outer surface of the rod.

To take full advantage of the benefits of the process in question, the segments, after the shrinkage following the extrusion process, must retain a radial dimension such that the said segments, as a result of the mechanical drawing process, touch one another without fusing together and form capillary ducts in the centre of the bar. It may happen, however, that even small variations in the extrusion temperature or in the quality of the thermoplastic material, or in its coefficient of contraction result in rather significant variations in the shrinkage of the segments in the radial direction, with the result that, even if the extrusion die has been manufactured to high precision dimensions, bearing in mind the final radial dimensions required for the segments, with a givan coefficient of contraction, if the latter decreases, after the mechanical drawing process, the segments will be excessively "crowded" in the centre of the rod, while if the coefficient of contraction increases, the segments will not succeed in making contact in the centre of the rod and will not form capillary ducts. In either case, it will not be possible to obtain a sufficiently strong flow of ink in the pen nibs manufactured from the rod.

In this connection, it should be noted that one purpose of the present invention is to eliminate the detrimental bore which was present in the centre of the ring of segments in pen nibs in accordance with the earlier state of the art and the diameter of which was of the order of only 5 hundredths of a millimeter. This gives an idea of the smallness of the dimensions to which it is necessary to work in order to control the process.

A second purpose of the invention is to check the shrinkage of the segments, or, in other words, to ensure that this shrinkage, apart from being very small in extent, is influenced as little as possible by variations in the extrusion temperature and in the coefficient of contraction of the thermoplastic material.

The above-mentioned two aims are achieved in accordance with a further improvement in the invention by a single, simple and original device consisting in that, during the extrusion process, several external longitudinal grooves are made in the thermoplastic rod, the spacing of which is so adjusted that they are filled, at least partially, by part of the material which is plastically deformed during the mechanical drawing process, thus receiving also any excess of material which may be contained in a local thickening of the external cross-section of the extruded rod.

In accordance with a preferred form of embodiment, the cross-section of these external longitudinal grooves is centred in the radial axis of the internal segments and the number of grooves is equal to that of the segments.

The cross-section of each of the grooves is preferably symmetrical and elongated in the radial direction of the rod and its axis coincides with the radial axis of a segment. The simplest shapes are to be preferred for this cross-sectional profile, such as rectangular or trapezoidal but there is nothing to prevent the use of grooves with e.g. convex or concave sides.

By means of these devices, when, during the first drawing pass, a thickened part of the rod appears, the material forming the excess thickness, instead of causing seizing of the rod with consequent rupture, is able to flow plastically to occupy the space suitably provided by the external grooves.

These external grooves, if they are made to correspond with the segments, make it possible to control the shrinkage of the latter far more effectively, inasmuch as behind the root of each segment there is a smaller quantity of material, which is equivalent to a reduction in the distance from the tip of the segment to the external surface of the rod. The shrinkage to which the segment is subjected is therefore less than it would experience in the absence of the grooves arranged behind them, on account of which the dimensioning is less sensitive to variations in the extrusion temperature and the coefficient of contraction of the thermoplastic material.

Another possibility offered by the improved process is that of checking quantitatively in project or experimental stages the shrinkage of the segments in the radial direction by adjusting the depth of the grooves, or by varying the height of the ribs with which the extrusion (die) root is provided to produce these grooves.

The longitudinal grooves are made in the outside of the extruded rod in accordance with the invention for a purpose which is entirely different from that for which, in the earlier state of the art, longitudinal grooves were made on the outside of pen nibs or styli, as in French Pat. No. 2,027,587 (Telbow Company Limited) or in U.S. Pat. No. 3,538,208 (Katsumi Ohtsuka). Those grooves in fact, served only to provide additional ducts, capillary or not, on the outside of the pen nib, to improve more or less successfully, the ink flow. It was not intended that the external grooves should receive part of the material from a plastic flow, as, moreover, is logical, inasmuch as there was absolutely no provision for a mechanical drawing process which, on the other hand, represents one of the most important features of the present invention.

The longitudinal grooves provided according to the invention, on the contrary, in no way serve the purpose of conducting ink, since they are designed to be completely closed by the material which is under plastic flow. Should their closure not be complete, it could happen that the partially closed grooves might participate in conducting the ink, but that would be accidental and somewhat undesirable.

The invention will be more clearly explained by the following description which refers to the attached drawings in which:

FIG. 1 is a longitudinal section of a conventional pen equipped with a nib or stylus of thermoplastic material of prior construction or according to the invention;

FIG. 2 is a cross-section, greatly enlarged, of the thermoplastic rod as it appears after extrusion;

FIG. 5 is a block diagram of the process carried out according to the invention to produce a rod and a pen nib in accordance with said invention with a cross-section e.g. similar to that of FIGS. 3 and 4;

To clarify the picture, we shall first refer to FIG. 1 which shows a conventional arrangement of a pen equipped with a pen nib or stylus P of plastic material in accordance with the earlier state of the art or in accordance with the invention.

The pen consists of a hollow tubular barrel C, e.g. made of moulded plastic material. The lower end of the barrel C is, as it were, "solid" and has a longitudinal bore in which the pen nib P is inserted, with a force fit. The pen nib consists of a small rod of plastic material, of circular profile, having internally a capillary duct or capillary duct system for the passage of the ink.

The diameter of the small rod P is usually of the order of from 1.5 to 2.5 mm and its length is usually of the order of from 10 to 20 mm. The two ends of the rod P are tapered, preferably with the same degree of taper to overcome the problem of orientation when the pen is assembled. Thus obviously the outer end of the rod P will form the actual stylus, intended for writing on paper, while the end located inside the barrel C is designed to penetrate into an ink-impregnated pad R. The pad R, of elongated cylindrical shape, is coupled to the pen nib P to which it transmits ink by the slight pressure exerted, if necessary through a spacer D, by a plug T inserted with a force fit into the end of the tubular barrel C opposite the pen nib P.

Figure 3:
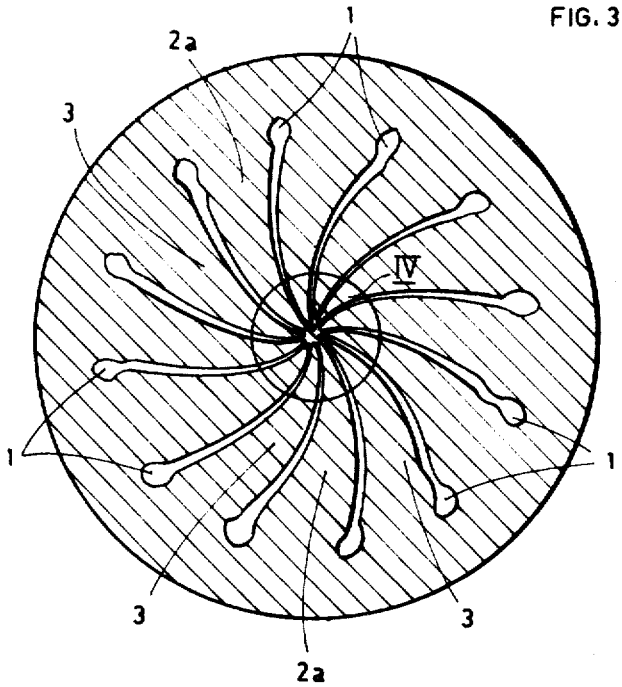
FIG. 3 is a cross-section, similar to FIG. 2, of the same rod after it has been reduced to the final diameter. This cross-section is also that of the finished pen nib.
Figure 4:
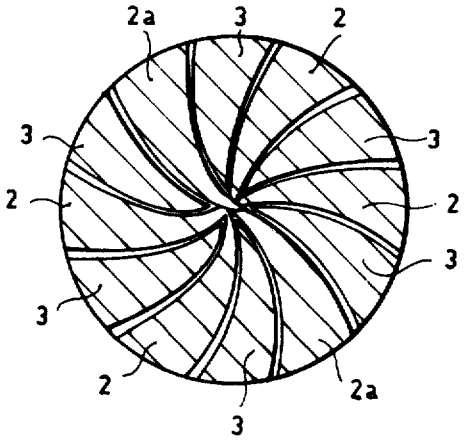
FIG. 4 shows on a greatly enlarged scale the part of the cross-section enclosed by the circle 4 in FIG. 3.

We shall now refer to FIGS. 2, 3 and 4 to explain the configuration of the internal channel of a pen nib P in accordance with a preferred form of embodiment of the invention.

As in the manufacture of pen nibs or styli in accordance with the earlier state of the art, first a thermoplastic rod of circular external profile is extruded. The thermoplastic material preferred is a polyacetal resin, such as e.g. that available commercially under the Trade Mark "Delrin", but it would be possible to use alternatively any other resins having similar characteristics.

The die used to extrude the thermoplastic rod has a configuration such as to form inside the rod a channel of star-shaped cross-section similar to that shown in FIG. 2. The cross-section of the internal channel comprises a number of radial arms defining a corresponding number of longitudinal ducts of substantially rectangular cross-section, radially arranged. Unlike the embodiments according to the earlier state of the art, the thermoplastic segments separating the channels 1 are not all of the same radial length, i.e. there are long segments 2, 2*a*, alternating with short segments 3, the tips of the latter being considerably further from the centre of the cross-section, i.e. from the central axis of the channel than those of the long segments 2, 2*a*. Two diametrically opposed long segments, denoted by 2*a*, are slightly longer than the other segments 2, for a reason to be explained later.

In the form of embodiment shown in the drawing, the arms or ducts 1 arranged radially are twelve in number, regularly distributed around the axis, since it has been found that this is the solution by which, in practice, without excessively complicating the manufacture of the extrusion die, a highly satisfactory distribution and a flow of ink is obtained in the finished pen nib The manufacture of the die is further simplified by the fact that the segments intended to form the ducts 1 do not require to be tapered. As will be seen, the ducts 1 which, as they are produced by means of extrusion, have parallel sides, automatically acquire a wedge-like shape, converging towards the longitudinal axis of the rod or pen nib, when the rod is subjected to a reduction of cross-sectional area by means of the mechanical drawing process.

A pen nib having a cross-section similar to that shown in FIG. 1 is not, however, satisfactory, inasmuch as the configuration of its star-shaped channel is similar to that of pen nibs in accordance with the earlier state of the art, having a wide central bore 4 which would give rise to the drawbacks already mentioned in the introduction. However, the rod the section of which is shown in FIG. 1 has been extruded with a far greater diameter than that required for the finished pen nib. Without any restricting purpose, and to clarify the general picture, it should be stated that, in a preferred practical embodiment, a rod of 10 mm diameter is extruded which by a preliminary stretching process, carried out without causing the tips and/or the sides of the segments to make contact with each other, is reduced to 4 mm, whereas it is desired to obtain finished pen nibs of 2 mm diameter.

The rod having a cross-section as shown in FIG. 2 is then subjected to a reduction of diameter by means of a mechanical cold-drawing operation or one conducted at a temperature considerably lower than that of the hot plastic deformation of the thermoplastic material, which takes place substantially at its sealing or fusion temperature. This operation represents an important feature of the present invention and will be described more clearly at a later stage.

As a result of the mechanical drawing process, the cross-section of the rod acquires the configuration shown in FIGS. 3 and 4, in which it can be seen that, whilst the tips of the short segments 3, after the deformation caused by the drawing, have not yet reached the centre, those of the long segments 2 and 2*a* have not only reached the cross-sectional centre point but have made contact with each other and, due to mutual interference, have been distorted by bending from one side to the other. Finally, the centre part of the rod cross-section has been substantially "filled", thus eliminating the central bore 4.

Due to inevitable defects in the manufacture of the extrusion die, in the case of long segments, all of the same nominal length, there will always be one or more of a slightly greater length than the others and the tips of these segments will be the first to reach the cross-sectional centre point during the drawing process. These segments, with their tips, may overlap the centre, whereupon the tips of the other long segments will be crushed against the sides of the segments which have overlapped the centre. This procedure is somewhat random, however, and it cannot be prevented that the long segments of greater effective length, will not all be grouped to one side which might result in a somewhat asymmetrically deformed final configuration, with filling of part of the cross-sectional area which might be somewhat off-centre.

It is precisely for this reason that the two diammetrically opposed long segments 2*a* are given a radial length slightly exceeding that of the other long segments 2. The segments 2*a* will thus undoubtedly be the first to reach the centre and to overlap it with their tips, riding one over the other during the drawing process, whereupon the tips of segments 2 will be crushed against the sides of segments 2*a*, resulting in an overall configuration as shown in FIG. 4. In this way, it is ensured that the part of the cross-sectional area which is filled lies substantially in the center, as desired.

To explain the general picture, in the case of pen nibs of 2 mm diameter, obtained by drawing a rod of 4 mm diameter, obtained in its turn by preliminarily stretching of a rod of 10 mm diameter, the longest segments 2*a* are extruded with an excess length of 2/10 mm compared with that of the other segments 2.

Moreover, due to the high degree of reduction obtained during the drawing process, the sides of the short segments 3 have come into contact, in the region near their tips, with the adjacent sides of the long segments 2 and 2*a*.

On completion of the mechanical drawing process, the rod drawn down to the final cross-sectional area is then cut into pieces of the required length, e.g. 18 mm, and simultaneously or successively, the two ends of the pieces are tapered to points, e.g. by grinding, as in the manufacturing processes according to the earlier state of the art.

In this way, finsiehd pen nibs P are obtained, having the advantages sought in accordance with the invention:viz:

The extensive "filling" of the centre of the cross-sectional area of the pen nib P provides an, as it were, "solid" tip, i.e. a tapered shape which can be finely pointed at the end of the pen nib, to be used for the purpose of writing on paper. The pen nib is thus capable of tracing a very fine line on paper.

The fact that the tip is "solid" gives it an enhanced resistance to wear since there is a greater quantity of material to be worn away by abrasion on the paper than in the case of tips of the truncated cone type with a central cavity in accordance with the earlier state of the art.

The mutual contact of the tips of the long segments 2 and 2*a* which, as a result of deformation, have come to bear one against the other either with their sides or with their edges, as well as the contact between the adjacent sides of all the segments 2, 2*a* and 3, cause these segments to support each other mutually and no longer act as if centilevered, for which reason they are no longer subject to vibrations likely to cause "spluttering" of the ink in the script.

Nevertheless, because the deformation has taken place at a temperature below the sealing temperature of the thermoplastic material, the segments have not become integrated and can therefore easily yield when the pen nib is pressed down on the paper, thus making it possible to produce a thicker script in proportion to the pressure exerted on the pen nib, which is precisely what is desirable to obtain a "personalized" script and for many other purposes on which it is unnecessary to dwell.

The fact that the segments offer mutual support further confers on them an increased yield strength, due to which the fineness of the script, for a given bearing pressure on the pen nib, remains substantially the same from the beginning to the end of the useful life of a pen nib in a pen of throw-away type, i.e. to be disposed of when the ink supply is exhausted.

Another highly important advantage of the invention arises from the fact that the reduction of cross-sectional area in the ducts 1 obtained by means of the mechanical drawing process automatically imparts to these ducts, originally having parallel sides, a wedge-like shape tapering towards the central axis of the pen nib. As the cross-section gradually converges upon the centre, the capillary force of the ducts 1 increases in like measure, until, in the centre of the pen nib, it reaches a very high maximum value.

In fact, at the point where the segments unite together, in reality, the surfaces of their sides or of their tips are only apparently in contact with each other, since between these surfaces, there still remain interstices carrying a very thin film of ink and having a very high capillary force. Unlike a pen nib with a duct of star-shaped cross-section with a central bore, in accordance with the earlier state of the art, the centre of the pen nib in accordance with the invention is thus the part with the highest capillary force and, furthermore, the interstices no longer constitute a discontinuity, isolating the radially arranged ducts from each other, but on the contrary establish optimum intercommunication between these ducts, thanks to which, if blocking of one or more ducts 1 occurs due to a clot or foreign body in the ink, or due to undesirable fusion of the parts as a result of defective extrusion or drawing, the blocked duct or ducts will again receive, downstream of the obstruction point, ink from the other free ducts, for which reason the ink flow always remains symmetrically distributed around the axis of the pen nib and the latter is no loger liable to suffer from the symmetry which has been discussed in the introduction.

Finally, as a result of the mechanical drawing process which makes it possible to obtain a high degree of reduction without danger of sealing or fusing, ducts 1 are obtained the capillary force of which is greater than that of similar ducts in the embodiments according to the earlier state of the art.

As will have been understood, the configuration with long segments 2, 2*a* and short segments 3 has been adopted in accordance with the preferred arrangement of the invention because, if all the segments were of the same radial length, the mechanical drawing process, the purpose of which is to eliminate the central bore 4, would result in all their tips joining tightly at the centre without overlapping it and it would not be possible for some of the tips to become distorted with the resulting advantageous tight packing at the actual centre.

As a result of the reduction in the cross-sectional area, the ducts 1 as can be seen in the drawing acquire a characteristic S-shaped contour, but this is only a minor consideration.

The high capillary force of the pen nib obtained according to the invention which has been confirmed by the comparative tests already mentioned represents yet another advantage, which is to make the behaviour irregularities, since the percentage fluctuations in the capillary force due to these causes will always be quite insignificant.

A preferred manner of carrying out the process will now be described whereby a rod is produced continuously having a cross-section similar to that shown in FIGS. 3 and 4 and whereby from this rod pen nibs according to the invention are produced.

This process and the appropriate equipment are shown in the block diagram in FIG. 5.

An extrusion machine 10, equipped with a suitable die, continuously extrudes a rod $B_1$ of thermoplastic material, having a cross-section as shown in FIG. 2 and a diameter which for practical purposes, as stated above, may be 10 mm. The rod $B_1$ on leaving the extrusion die, immediately passes into a cooling water basin, 11, which reduces the temperature to a value substantially below that of hot plastic deformability, and thus below the sealing or fusing temperature. Downstream of the basin 11 there is a drawing unit 12 which pulls the rod $B_1$ from the extrusion die 10, through the basin 11. The tractive force exerted by the drawing unit 12 subjects the rod $B_1$ between the extruder 10 and the basin 11 to a preliminary stretching which reduces the diameter by an amount suitable for the purposes of the subsequent mechanical drawing stage but such that the internal segments do not come into contact with each other and become sealed or fused. As already stated, starting from a diameter of 10 mm, in practice, stretching reduces the rod diameter to 4 mm.

Immediately downstream of the drawing unit 12, the rod $B_2$ passes through a heater 13, e.g. an electric resistance heater, which raises the temperature to a value below the sealing or fusion temperature of the thermoplastic material, but such as to normalise or anneal the said material, eliminating any brittleness caused by the preceding cooling process.

After passing through the heater 13, the rod $B_2$ is subjected to a first mechanical drawing operation, which is an important feature of the process according to the invention. This drawing process is effected by passing the bar through a unit 14 consisting of a series of drawplates of circular cross-section and of diameter progressively decreasing until the cross-section is substantially as shown in FIGS. 3 and 4, which reduce the rod diameter substantially to the final value, which may be approximately half that of the extruded and preliminarily stretched rod $B_2$. In the practical application already mentioned, a rod of 4 mm diameter is thus reduced to a diameter a little greater than 2 mm.

In an installation already successfully used in practice, the mechanical drawing unit 14 consists of a set of six drawplates, each of which is equipped, downstream, with its own drawing device.

The rod $B_3$ of reduced cross-section, issuing from the drawing unit 14, passes into a second cooling basin 15 which absorbs the heat generated by the drawing process from the thermoplastic material, whereupon it is passed into a unit 16 of well-known type caused a "Turk's head", consisting of four grooved rollers, arranged in a cross-shaped pattern, in such a manner that the four grooves delimit a circular passage. During the passage through this circular passage, an almost perfect circular cylindrical shape is imparted to the outer surface of the rod $B_3$ or, in better terms, this shape is restored when it has been lost by the rod during its passage downstream of the drawing unit 14, e.g., due to ovalization caused by possible deflection, if the track is not rectilinear but reverses, as shown diagrammatically in the drawing.

After passing through the "Turk's head" 16, the rod $B_3$ is again subjected to a mechanical finishing or gauging drawing, in a unit 17, which, like unit 14, consists of a series of drawplates of circular cross-section.

In the unit 17, by a slight reduction, the rod B3 is given the exact diameter required, within the permissible tolerances, for inserting the pen nib P, with a force fit, into the hole, e.g. in the barrel C of the pen shown in FIG. 1, which forms its seating.

In the equipment used in practice, which has already been discussed above, the final mechanical drawing unit 17 consists of a series of three drawplates, each of which is equipped downstream with its own drawing means.

Downstream of the final drawing unit 17, the rod $B_3$, finally gauged to the desired diameter, e.g. 2 mm in the practical embodiment instanced as an example, again passes into a third cooling basin 18 having the same purpose as that of the basin 15.

This terminates the continuous process for manufacturing a rod having an internal capillary duct of star-shaped cross-section in accordance with the invention.

On leaving the basin 18, the rod $B_3$ passes into a cutting device 19 which divides it into pieces or small rods substantially of the length desired for the pen nibs P to be produced.

These small rods are pointed at both ends to the tapered shape already previously discussed, by a suitable grinding machine, providing in this way pen nibs P similar to that shown in FIG. 1.

Alternatively, the operation of shaping the tapered tips at the two ends of the small rods could be effected simultaneously with the cutting thereof from the bar, e.g. by means of suitably tapered grinders.

In the above description, a continuous process has been considered, but it will be obvious that, while still remaining within the scope of the invention, it would be possible to produce extruded rods (and possibly subject them to the preliminary stretching operation) and store them, e.g. in rolls, subjecting them later to the mechanical drawing process and the other accompanying operations.

To evaluate the behaviour and advantages of the pen nibs in accordance with the invention, some comparative tests have been made.

Samples of pen nibs according to the invention (A) and commercially available samples of pen nibs of type (B) with an internal capillary duct of star-shaped cross-section were subjected to these tests.

The characteristics of the samples were as follows:

Pen Nibs According to the Invention

Capillary duct of star-shaped cross-section with 12 arms similar to that shown in FIGS. 3 and 4.

| | |
|---|---|
| Outside diameter of pen nib: | 2 mm |
| Length of pen nib: | 12.5 mm |
| Width of radially arranged capillary ducts | about 0.6 mm at the peripheral end and about 0 mm at the centre |
| Diameter of outside envelope circle for the radial arrangement of capillary ducts: | 1.3 mm |

Commercially Available Pen Nibs B

Capillary duct of star-shaped cross-section with 6 straight radial arms opening into a central bore

| | |
|---|---|
| Outside diameter of pen nib: | 2 mm |
| Length of pen nib | 12.5 mm |
| Width of capillary ducts: | about 0.02 mm at the peripheral end and about 0.01 mm at the opening into the central bore |
| Diameter of central bore: | about 0.5 mm |
| Diameter of outside envelope circle for the radial arrangement of capillary ducts. | 1.3 mm. |

A first test consisted in estimating the ink rising time in the two pen nibs as a result of the capillary force, using for this purpose the appropriate "Kruss" meter and carrying out the test according to the Kelber method.

With an ink having a surface tension of 55 dynes/cm, the following results were obtained:

| | |
|---|---|
| Pen nib A: | 1 sec. |
| Pen nib B: | 10 sects. |

With an ink having a surface tension of 32 dynes/cm, on the other hand, the following values were obtained:

| | |
|---|---|
| Pen nib A: | 1 sec. |
| Pen nib B: | 5 secs. |

As can be seen, pen nib A according to the invention has a far greater capillary force than that of the commercially available pen nib B and, moreover, while pen nib B is highly sensitive to variations in the surface tension of the ink, pen nib A is practically insensitive to these variations.

It is obvious from this that with a pen nib according to the invention, the choice of a suitable composition for the ink is of no practical importance.

In another test, pen nibs A and B, filled with ink and arranged horizontally were put in contact by one of their tips with blotting paper for an interval of 2 seconds in order to estimate the tensile strength of the ink flow contained in the capillary duct.

Before the test was made, the pen nibs A and B were weighed empty, i.e. before they were filled with ink and then in the filled state.

After the test, the pen nibs were again weighed to determine the amounts of ink retained or lost to the blotting paper respectively.

The results are given in the following table:

| | Pen weight nib when empty g | Weight when filled g | Weight of ink charge g | Weight after ink loss g | Quantity of ink lost g | Residual ink in pen nib g | % ink loss |
|---|---|---|---|---|---|---|---|
| A | 0.0714 | 0.0770 | 0.0056 | 0.0720 | 0.0050 | 0.0006 | 89.3 |
| B | 0.0665 | 0.0723 | 0.0058 | 0.0685 | 0.0038 | 0.0020 | 65.5 |

These figures show that pen nib A according to the invention loses practically all the ink, inasmuch as the ink flow is not interrupted owing to the high capillary force available whereas the commercially available pen nib B is able to release only a small percentage of ink, in view of its comparatively weak capillary force, which allows the ink flow inside the duct to be interrupted.

A pen nib according to the invention will therefore always be ready for writing purposes even after long periods of disuse, unlike the pen nibs at present available on the market, which, even if special inks are used, which thanks to the present invention are no longer necessary, can frequently not be reused for writing purposes because of the interrupted ink flow.

Finally, an ink consumption test was carried out on pen nibs A and B.

With a stock of 1.5 gr ink, pen nibs A according to the invention could be used to draw a line of length from 2500 to 3000 meters, while the line drawn with pen nibs B, in the same conditions, measured only 1200 meters.

Thus it can be seen from the foregoing that a pen or similar writing means equipped with a pen nib according to the invention has substantial advantages with respect to the previous state of the art, which can be briefly summed up as follows:

- greater reliability in operation;
- practically constant fineness of script, far superior to that possible with pen nibs according to the previous state of the art, for the whole duration of the ink stock, but with the possibility of thickening the script at will by pressing down on the pen;
- a smoother script, free from vibrations and therefore "cleaner";
- greater utilisation of the ink stock, making it possible to write to a longer period with a quantity of ink equal to that contained in a pen fitted with a pen nib according to to the previous state of the art, or with a smaller ink stock, to have the same writing period, i.e. pen life as that obtained with pen nibs according to the previous state of the art.

Figure 6:
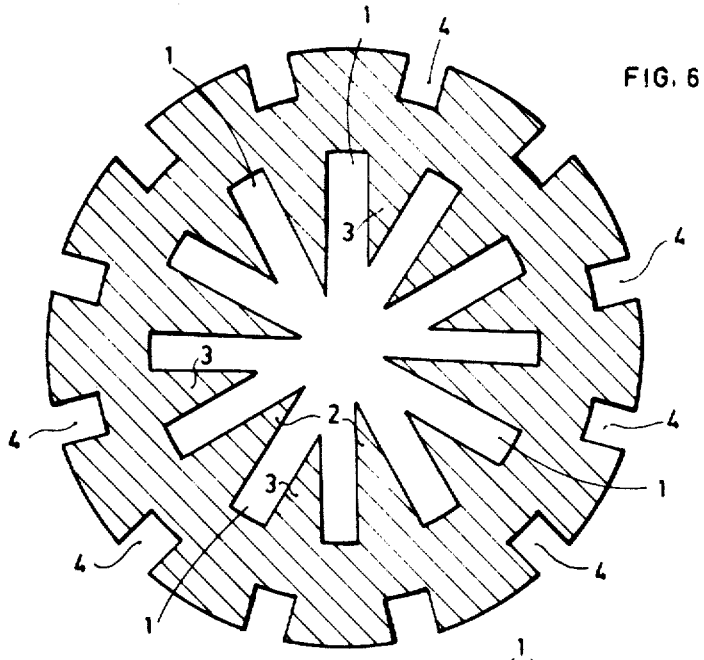
FIG. 6 shows a cross-section, greatly enlarged, of the thermoplastic rod with external grooves, as it appears after extrusion.
Figure 7:
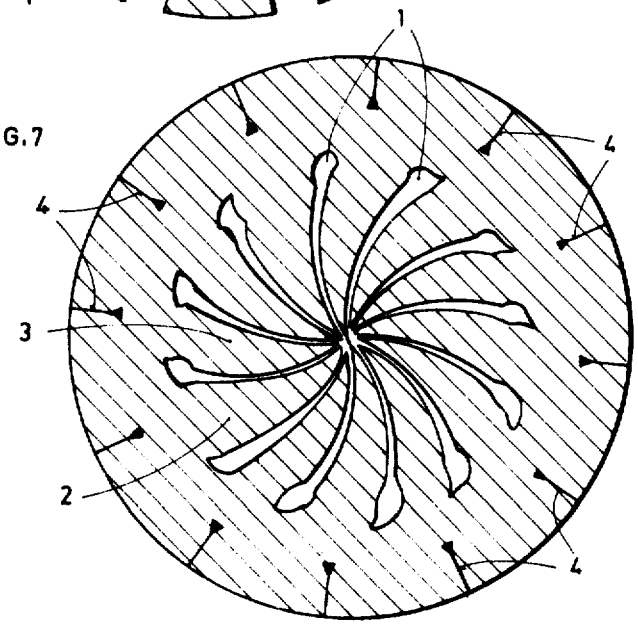
FIG. 7 shows a cross-section similar to FIG. 6 of the same rod after it has been reduced to its final diameter by mechanical drawing.

Referring to FIGS. 6 and 7, the star-shaped cross-section of the internal duct of the thermoplastic rod is similar to the cross-section previously discussed and consists of a number of radial arms 1 delimiting longitudinal channels separated by long segments 2 and short segments 3.

The improvement which will now be described consists in the fact that during the extrusion process, slots or grooves 4 (FIG. 6) are made on the periphery of the rod, in this case of substantially rectangular cross-section but which, as stated above, could alternatively have another type of section, e.g. trapezoidal. The grooves 4 have a symmetrical shape with reference to their major axis which coincides with the radial axis of the respective segments 2 and 3. The radial depth of the grooves 4 is such that their base lies at a distance, outwards, from the root of the segments 2, 3 of the same order of magnitude as the width of this root, in order to obtain, in addition to the reduction which is obtained as a result of shrinkage of the segments 2, 3, more uniform processes during this shrinkage. In FIG. 7, it can be seen how the grooves 4 have closed, since the space has been occupied at least partially by adjacent parts of the material which has been plastically deformed in the cold drawing process, receiving also any existing excess material due to a local thickening of the outside diameter of the extruded rod.

It will be clear that the grooves 4 should have before the drawing process (FIG. 6) dimensions (particularly in the direction of the width) such as to permit reduction of the rod by extrusion to the required final diameter, even if localised thickening of the outside cross-section takes place in the extruded rod.

Naturally, while the basic principles of the invention remain unchanged its detailed execution can be widely varied as compared with what has been shown and described as a non-restrictive example, without thereby transgressing the scope of the invention.

Having described our invention, we claim:

1. A process for manufacturing a pen nib with capillary ink passages which is capable of providing a fine script without vibration, comprising heating a mass of thermoplastic material to a temperature higher than that at which it fuses, extruding from said mass of thermoplastic material a rod through a die so shaped as to form inside the rod a longitudinal opening of star-shaped cross section characterized by a plurality of substantially parallel sided ducts that communicate with each other at the center of said cross section, said ducts being separated by wedge-shaped segments of said thermoplastic material, said segments being spaced from each other and being alternately long and short and at least two diametrically opposed long segments being even longer than the other long segments, said variations in segment length resulting in the disposition of the inner points of said segments at different distances from the center of said rod, cooling the extruded rod to a temperature lower than at which the thermoplastic material fuses, and mechanically drawing the cooled rod to reduce its outside diameter and also to reduce the width of said channels until said channels have a wedge-like shape tapering toward the central axis of the rod and at least said two segments contact each other.

2. A process as claimed in claim 1, in which the outside diameter of said rod is reduced by said mechanical drawing by about 50%.

3. A process as claimed in claim 1, and cooling the rod a second time after it has been subjected to said mechanical drawing, and then rolling said twice-cooled rod through a passage of circular cross-section defined by grooved rollers thereby to rectify any defects in the circularity of the outside profile of the rod, and then subjecting the rod to a second drawing process to gauge the rod to a predetermined diameter, and thereafter cooling the gauged rod.

4. A process as claimed in claim 1, and annealing the rod at a temperature lower than said fusing temperature after said cooling but prior to said mechanical drawing.

5. A process as claimed in claim 1, in which said cooling is effected by passing the rod through water.

6. A process as claimed in claim 1, and stretching said rod prior to cooling.

7. A process as claimed in claim 6, in which the outside diameter of said rod is reduced by said stretching by about 60%.

* * * * *